US005757115A

United States Patent [19]

Narita et al.

[11] Patent Number: 5,757,115

[45] Date of Patent: May 26, 1998

[54] CATHODE MEMBER AND ELECTRON TUBE HAVING THE CATHODE MEMBER MOUNTED THEREON

[75] Inventors: Maki Narita; Toshikazu Sugimura; Hiroyuki Sakatani; Tsuyoshi Tanabe, all of Shiga, Japan

[73] Assignee: NEC Corporation, Tokyo, Japan

[21] Appl. No.: 455,998

[22] Filed: May 31, 1995

[30] Foreign Application Priority Data

May 31, 1994 [JP] Japan ..... 6-118221
Dec. 26, 1994 [JP] Japan ..... 6-321908

[51] Int. Cl.[6] ..... H01J 1/14; H01J 19/06; H01J 1/02; H01J 1/38

[52] U.S. Cl. ..... 313/346 R; 313/355

[58] Field of Search ..... 313/346 R, 337, 313/346 DC, 355, 452

[56] References Cited

U.S. PATENT DOCUMENTS

| | | | |
|---|---|---|---|
| 2,912,611 | 11/1959 | Beck et al. . | |
| 3,183,396 | 5/1965 | Becker et al. . | |
| 3,924,153 | 12/1975 | McIntyre | 313/452 X |
| 4,313,854 | 2/1982 | Sunahara et al. | 313/346 R |
| 4,350,920 | 9/1982 | Bertens | 313/346 R |
| 5,072,149 | 12/1991 | Lee et al. | 313/346 R |
| 5,306,189 | 4/1994 | Sugimura et al. | 313/346 DC X |
| 5,334,085 | 8/1994 | Shroff | 313/346 DC X |
| 5,507,675 | 4/1996 | Frost | 313/346 DC |
| 5,592,043 | 1/1997 | Gärtner et al. | 313/346 R X |

FOREIGN PATENT DOCUMENTS

| | | |
|---|---|---|
| 0 005 279 | 11/1979 | European Pat. Off. . |
| 0 409 275 | 1/1991 | European Pat. Off. . |
| 0 537 495 | 4/1993 | European Pat. Off. . |
| 2 297 490 | 8/1976 | France . |
| 2 425 144 | 11/1979 | France . |
| 2 683 090 | 4/1993 | France . |
| 54-100249 | 8/1979 | Japan . |
| 60-170137 | 9/1985 | Japan . |

OTHER PUBLICATIONS

"Applied Physics", vol. 56, No. 11, pp. 13–22, Aug. 1987.

*Primary Examiner*—Sandra L. O'Shea
*Assistant Examiner*—Mack Haynes
*Attorney, Agent, or Firm*—Young & Thompson

[57] ABSTRACT

With a production of a cathode member for an electron tube having cathode materials containing Ni, a metal having a reduction behavior and an electron emissive agent sintered to be one body and its electron emitting surface subjected to a specular processing, it is possible to obtain an inexpensive cathode characterized by that: the operation temperature is low; the electron emission distribution is excellent because of the smooth electron emitting surface; and the electron emission is enabled with a high current density for a long interval of time.

13 Claims, 3 Drawing Sheets

CATHODE MEMBER AND ELECTRON TUBE HAVING THE CATHODE MEMBER MOUNTED THEREON

BACKGROUND OF THE INVENTION

1. Field of the Invention

The present invention relates to a cathode member for generating thermoelectrons in a vacuum and an electron tube using the cathode member, and more particularly to a cathode ray tube (referred to as a CRT hereinbelow).

2. Description of the Related Art

A prior art cathode for a CRT is disclosed in "Applied Physics", Vol. 56, No. 11, pp. 13–22 (1987), and a first example thereof will be explained in connection with an oxide coated cathode illustrated in FIG. 5.

In FIG. 5, a reference numeral 50 denotes an oxide coated cathode; 51, an electron emissive agent consisting of (Ba, Sr, Ca) $CO_3$; 52, a substrate consisting of nickel (Ni) including Mg, Si and others; 53, a cathode sleeve consisting of Ni—Cr; and 54, a heater.

Next, a manufacturing method for the oxide coated cathode will be described.

A solution obtained by mixing (Ba, Sr, Ca) $CO_3$ powder into an organic solvent in which nitrocellulose dissolves is sprayed on a surface of the substrate 52 to form a coat having a film thickness of approximately 100 μm. Upon assembling the oxide coated cathode 50 in the electron tube, the electron emissive agent 51 is heated to approximately 1000° C. by the heater 54 during the evacuation and the thermal decomposition expressed as (Ba, Sr, Ca) $CO_3 \rightarrow$(Ba, Sr, Ca) $O+CO_2 \uparrow$ is performed to convert carbonate into oxide. After sealing the electron tube, the electron emissive current is fetched while heating at about 1000° C. by the heater 54. At this time, BaO within the electron emissive agent 51 reacts with the metal having a reduction behavior such as Mg and Si diffused from inside of the substrate 52 at the interface between the electron emissive agent 51 and the substrate 52 to generate free barium (Ba). This process is referred to as the activation. The completion of the activation makes the finished oxide coated cathode 50.

The finished oxide coated cathode 50 is heated by the heater 54, and the thermoelectron is emitted from the electron emissive agent 51 at approximately 760° C.

As a method for adding the reductive metal such as Mg and Si into Ni and alloying this metal, a vacuum dissolving method by which Ni and the reductive metal are dissolved and mixed in a vacuum and then cooled to perform alloying is conventional.

Next, an improved product of the oxide coated cathode referred to as "a sintered cathode" will now be described as a conventional example 2 (see Japanese Laid-open Patent Application No. 54-100249).

FIG. 6 is a sectional view of the sintered cathode. In FIG. 6, a reference numeral 60 designates a sintered cathode; 51, an electron emissive agent; 53, a cathode sleeve; 54, a heater; and 61, a sintered Ni substrate including the reductive metal such as Al, C, Mg, Si or Zr.

The substrate 61 is manufactured by: grinding the (reductive metal—Ni) alloy; mixing the ground alloy with the Ni powder; heating and sintering the mixture in a hydrogen furnace at approximately 1050° C.; and rolling, punching and molding the sintered product.

Thereafter, the coat forming, the thermal decomposition and the activation of the electron emissive agent 51 are carried out to obtain the finished sintered cathode 60 in the similar manner as the conventional example 1.

As a conventional example 3, still another cathode referred to as "a matrix cathode" will now be explained with reference to FIG. 7 (See Japanese Laid-open Patent Application No. 60-170135).

FIG. 7 is a sectional view of a matrix cathode. In FIG. 7, a reference numeral 70 denotes a matrix cathode; 53, a cathode sleeve; 54, a heater; 71, a cathode pellet; and 72, a cathode cap.

The cathode pellet 71 is manufactured by: mixing heat resistant metal powder consisting of W or Mo with electron emissive agent powder having as its material a compound or a mixture including at least one of ($Al_2O_3$, CaO, MgO, $Sc_2O_3$, $Y_2O_3$, $ZrO_2$ and SrO) and BaO; and press-shaping and thereafter sintering the obtained mixture at a high temperature. The matrix cathode 70 is different from the conventional examples 1 and 2, and the coat formation and the thermal decomposition of the electron emissive agent are not required.

In regard to the oxide coated cathode of the conventional example 1, the electron emission can be obtained at the lowest temperature among the practical cathodes and this cathode is very inexpensive, but its duration of life is extremely short when the electron emission is carried out with high current density. Its cause will be explained hereinbelow ("Applied Physics", Vol. 56, No. 11, pp. 13–22 (1987)).

The low work function of the oxide coated cathode can be obtained because BaO is reduced by the reductive metal such as Mg and Si to be free Ba, meanwhile Mg or Si becomes a reaction product such as MgO or $BaSiO_4$ and is deposited on the interface between the electron emissive agent 51 and the substrate 52 to form an intermediate layer (not shown). Since this intermediate layer has a large electric resistance, Joule heat is excessively generated in the intermediate layer when the current flowing across the intermediate layer is large (namely, when performing the electron emission with high current density), which leads to dissolution and decomposition of the electron emission agent 51 by extreme heat or peeling of the electron emissive agent 51 from the substrate 52, thereby remarkably shortening the duration of life.

Thus, the maximum emission current density of the oxide coated cathode in the conventional example 1 is restricted to approximately 0.5 A/cm$^2$, and this cathode cannot be used for a CRT for a high density TV (HDTV), a CRT for a large TV or a CRT for a high definition display because of an insufficiency of the brightness.

In addition, since the oxide coated cathode in the conventional example 1 is produced by using a spraying method, the electron emissive surface exhibits excessive unevenness and its maximum depth becomes approximately 30 μm. The electron emission distribution is, therefore, deteriorated, and the focusing characteristics on the CRT screen become poor, thereby generating the moire strips. As apparent from this drawback, the oxide coated cathode is not suitable for the CRT for the high definition display.

Further, in regard to the Ni alloy substrate obtained in accordance with the conventional vacuum dissolving method, even if the reductive metal is uniformly dispersed during the dissolution, the reductive metal is segregated to the Ni grain boundary at the time of solidification, and hence the uniform alloy cannot be formed. Moreover, when the alloy is ground to obtain the impalpable powder, the reductive metal which is active is oxidized at the time of grinding and its reduction behavior is lost, and hence the grinding is impossible until the grain size becomes sufficiently uniform. There is anyhow a problem such that the reduction behavior of the reductive metal cannot be uniformly obtained.

An object of the sintered cathode according to the conventional example 2 is to prevent an inconvenience which appears in the prior art oxide coated cathode, i.e., to prevent the deposition of the intermediate layer on the interface between the electron emissive agent 51 and the substrate 52 from disturbing the current. Since the substrate 61 has a porous sintered body and the penetration of the electron emissive agent 51 into its pores enlarges the contact area between the substrate 61 and the electron emissive agent 51, the deposition thickness of the intermediate layer is thin as compared with that of the oxide coated cathode according to the conventional example 1. The depth of penetration of the electron emissive agent 51 is, however, small as compared with the thickness of the substrate 61, and hence the effect of reducing the intermediate layer thickness is not sufficient.

In addition, since the sintered cathode according to the conventional example 2 is also produced by the spraying method in a similar manner to the oxide coated cathode according to the conventional example 1, the electron emitting surface exhibits excessive unevenness, deteriorating the focusing characteristics on the CRT screen.

Since the matrix cathode according to the conventional example 3 does not contain the reductive metal such as Mg and Si for generating the intermediate layer, the intermediate layer does not restrict the current density, as contrasted to the sintered cathode according to the conventional example 2. However, since the matrix cathode does not contain the reductive metal and generates less free barium (Ba), the operation temperature is increased (approximately 960° C.) and the cathode sleeve and the cathode cap must be made of an inexpensive heat resisting metal, thereby increasing the cost.

SUMMARY OF THE INVENTION

In view of the above-described problems of the conventional cathodes, it is therefore an object of the present invention to inexpensively provide cathodes which stably enable a high density electron emission (2 to 10 A/cm$^2$) equivalent to that of the matrix cathode (the conventional example 3) at a low operation temperature similar to that of the oxide coated cathode (the conventional example 1) for a long period (30,000 hours or more) and whose surface electron emission distribution is excellent, and also provide an inexpensive electron tube which has such a cathode mounted thereon and has properties of high brightness, long duration of life and low power consumption.

According to the present invention, the cathode contains at least Ni, a reductive metal and an electron emissive agent and is sintered to be one body by a hot isostatic pressing process, and its electron emitting surface is subjected to a specular processing.

Further, according to the present invention, the cathode contains at least Ni, a reductive metal, an electron emissive agent and an intermediate layer generation inhibitor and is sintered to be one body by a hot isostatic pressing process, and its electron emitting surface is subjected to a specular processing.

Furthermore, according to the present invention, a reductive metal of the cathode is selected from Mg, Si, Zr, Ta, Al, Co and Cr.

Moreover, according to the present invention, a reductive metal of the cathode is W and a metal selected from Mg, Si, Zr Ta, Al, Co and Cr.

In addition, according to the present invention, an electron emissive agent of the cathode contains at least Ba carbonate or Ba oxide.

Further, according to the present invention, Ni and a reductive metal of the cathode are alloyed before the hot isostatic pressing process.

Furthermore, according to the present invention, Ni and a reductive metal of the cathode are sintered to be one body by the hot isostatic pressing process.

Moreover, according to the present invention, an intermediate layer generation inhibitor of the cathode consists of rare earth metal or rare earth metal oxide.

In addition, according to the present invention, the rare earth metal of the cathode is selected from Sc, Y, La, Ce and Dy and the rare earth metal oxide of the same is selected from oxide of the rare earth metal.

Further, according to the present invention, the intermediate layer generation inhibitor of the cathode consists of an In compound.

Furthermore, according to the present invention, Ni and the reductive metal of the cathode are alloyed by a mechanical alloying method.

Since the cathode member for an electron tube according to the present invention contains at least Ni, a reductive metal and an electron emissive agent and is sintered to be one body by a hot isostatic pressing process (referred to as an HIP process hereinbelow), and its electron emitting surface is subjected to a specular processing, the following effects can be obtained:

(1) Ni, the reductive metal and the electron emissive agent which have different fusing points are firmly sintered to be one body by a pressure effect of the HIP process.

(2) Since the electron emissive agent is reduced by the reductive metal and a large amount of metal atom which is effective for the electron emission is generated, a sufficient electron emission can be obtained at a low temperature of approximately 760° C.

(3) Since a contact area between Ni and the electron emissive agent is large as compared to those of the conventional examples and an amount of the intermediate layer deposit per one unit area is small, there are few emission current density limits by the intermediate layer. The duration of life of the cathode member is thus long even when performing electron emission with a high current density.

(4) Since the electron emitting surface has less unevenness and is smooth, the uniform electron emission distribution can be obtained and the focusing characteristics on the CRT screen are excellent, thereby generating no defective moire strips. The cathode member is therefore preferable to a CRT for a high definition display.

Further, since the cathode member, whose electron emitting surface is subjected to the specular processing, contains at least Ni, the reductive metal, the electron emissive agent and the intermediate layer generation inhibitor and is sintered to be one body by the HIP process, the cathode member for an electron tube according to the present invention can obtain the following effect as well as the above-described effects (1), (2), (3) and (4).

(5) Since the intermediate layer generation inhibitor suppresses the deposit of the intermediate layer, no intermediate layer is generated. The duration of life of the cathode member is thus long even when emitting electrons with a high current density.

Further, alloying Ni and the reductive metal by the mechanical alloying method involves the uniform dispersion of the reductive metal which is difficult by the vacuum dissolving method, producing alloy particles whose diameters are uniform at a low cost.

BRIEF DESCRIPTION OF THE DRAWINGS

The novel features believed characteristics of the invention are set forth in the appended claims. The invention itself, however, as well as other features and advantages thereof, will be best understood by reference to the detailed description which follows, read in conjunction with the accompanying drawings, wherein:

DESCRIPTION OF PREFERRED EMBODIMENTS

Figure 1:
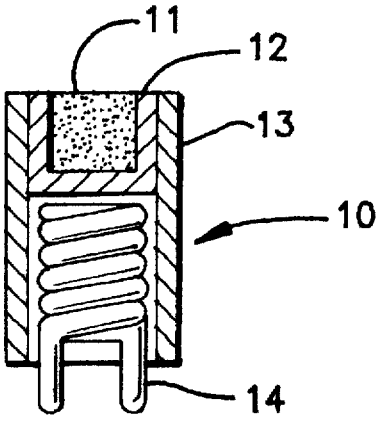
FIG. 1 is a sectional view showing a cathode using a cathode member according to one embodiment of the present invention.
Figure 5:
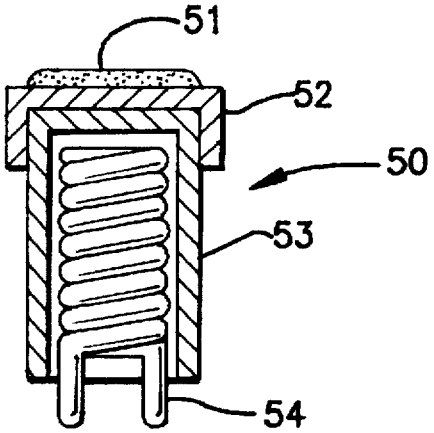
FIG. 5 PRIOR ART
FIG. 5 is a sectional view showing an oxide coated cathode according to a conventional example 1.
Figure 6:
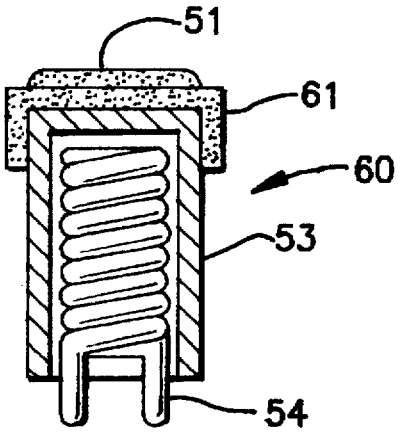
FIG. 6 PRIOR ART
FIG. 6 is a sectional view showing a sintered cathode according to a conventional example 2.
Figure 7:
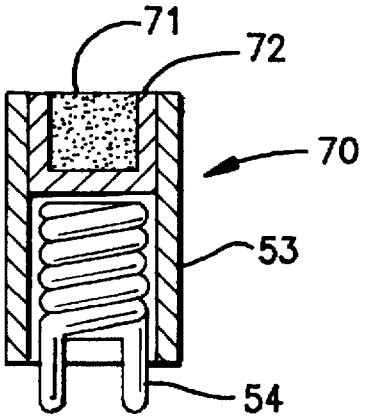
FIG. 7 PRIOR ART
FIG. 7 is a sectional view showing a matrix cathode according to a conventional example 3.

Referring to FIG. 1, in a cathode 10, a cathode sleeve 13 accommodates a cathode cap 12 having a cathode pellet 11 using a cathode member according to the present invention filled therein. A heater 14 is inserted from a lower portion of the cathode sleeve 13.

A description will be given as to a method for manufacturing one embodiment (referred to as an embodiment 1 hereinbelow) of a cathode member according to the present invention.

Figure 2:
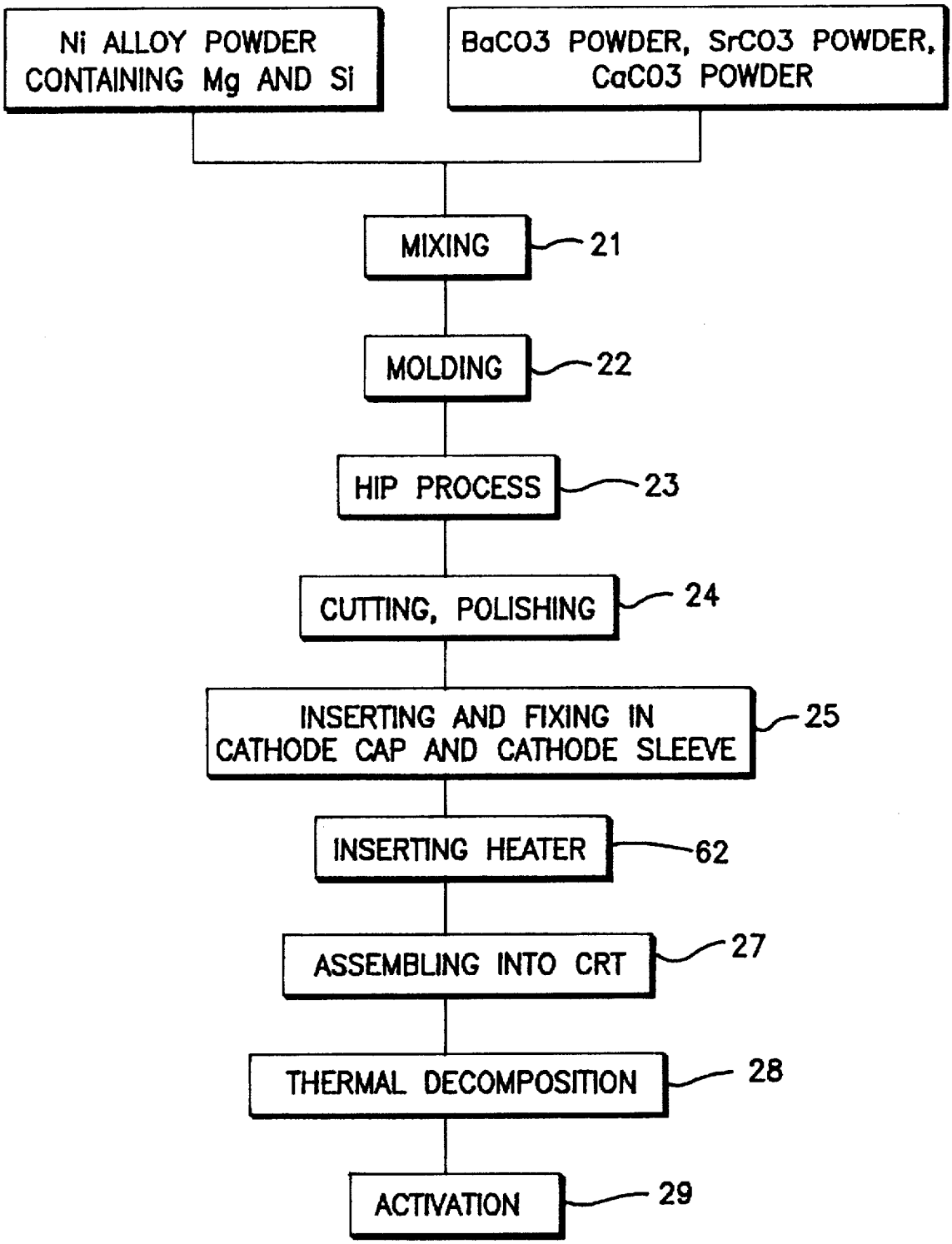
FIG. 2 is a manufacturing process diagram of the cathode using a cathode member according to the embodiment of the present invention.

Ni alloy powder including Mg and Si, $BaCO_3$ powder, $SrCO_3$ powder and $CaCO_3$ powder are well mixed by using a ball mill (step 21 in FIG. 2)

Here, it was found that: a mean particle diameter of the Ni alloy powder was 5 μm; a mean particle diameter of the $BaCO_3$ powder, the $SrCO_3$ powder and the $CaCO_3$ powder was 2 μm, respectively; a volume ratio of (the Ni alloy powder): (the $BaCO_3$ powder+the $SrCO_3$ powder+the $CaCO_3$ powder) was 45:55; and amounts of Mg and Si were 0.1% by weight and 0.03% by weight of Ni, respectively.

Further, in regard to a ratio of the $BaCO_3$ powder, the $SrCO_3$ powder and the $CaCO_3$ powder, a mole ratio of Ba:Sr:Ca is 5:4:1.

The Ni alloy powder used herein is obtained by sealing 0.1 g of Mg powder, 0.03 g of Si powder and 99.87 g of Ni powder each of which has a particle diameter of 5 μm in an agate mortar with agate balls in an argon gas atmosphere and ball-milling them in an epicyclic ball mill apparatus for four hours, and this powder is alloyed by a mechanical alloying (MA) method. As for the agate balls, the diameter was 10 mm; the number was 20; and the acceleration was approximately 120 G. As an apparatus suitable for the MA method, there is, e.g., a high speed epicyclic mill disclosed in "Tribologist" magazine, Vol. 38, No. 11, pp. 1024–1030 (1993), but any apparatus adopting other methods such as a high speed vibration and an ultrasonic vibration may be used only if it is capable of applying a large acceleration (for example, 100 to 150 G).

In regard of a mean particle diameter of the above-mentioned materials, a mean particle diameter of not less than 0.5 μm and not more than 30 μm is suitable for the Ni alloy powder and a mean particle diameter of not less than 0.05 μm and not more than 10 μm is suitable for the $BaCO_3$ powder, the $SrCO_3$ powder and the $CaCO_3$ powder.

Further, in regard of the mixing ratio and the composition ratio, the above-described effects can be obtained when the volume ratio of (the Ni alloy powder): (the $BaCO_3$ powder+the $SrCO_3$ powder+the $CaCO_3$ powder) is in a range between 5:95 and 95:5 and when the amounts of Mg and Si are equal to or above 0.01% by weight and equal to or below 3% by weight of Ni, respectively. In particular, it may be preferably that the volume ratio of (the Ni alloy powder): (the $BaCO_3$ powder+the $SrCO_3$ powder+the $CaCO_3$ powder) is in a range between 35:65 and 65:35 and the amounts of Mg and Si are equal to or above 0.05% by weight and equal to or below 1% by weight of Ni, respectively.

Subsequently, the above-mentioned mixed powder is filled and sealed in a rubber die, and the pressure is then applied to the powder by a uniaxial pressing apparatus or a cold isostatic pressing apparatus (a CIP apparatus) to manufacture a molded product (step 22 in FIG. 2).

The molded product is then sealed in a glass capsule (not shown) in a vacuum so that the glass prevents the high pressure gas from entering inside the molded product at the time of the hot isostatic pressing (HIP) process, thereby completely applying the pressure to the molded product. Further, the vacuum sealing can prevent the molded product from defectively reacting with oxygen or nitrogen in the HIP process. Since the defective reaction is caused between the molded product and the capsule during the HIP process when the molded product are directly brought into contact with the capsule, powder of such as aluminum oxide or boron nitride (BN) is filled between the molded product and the capsule.

Figure 3:
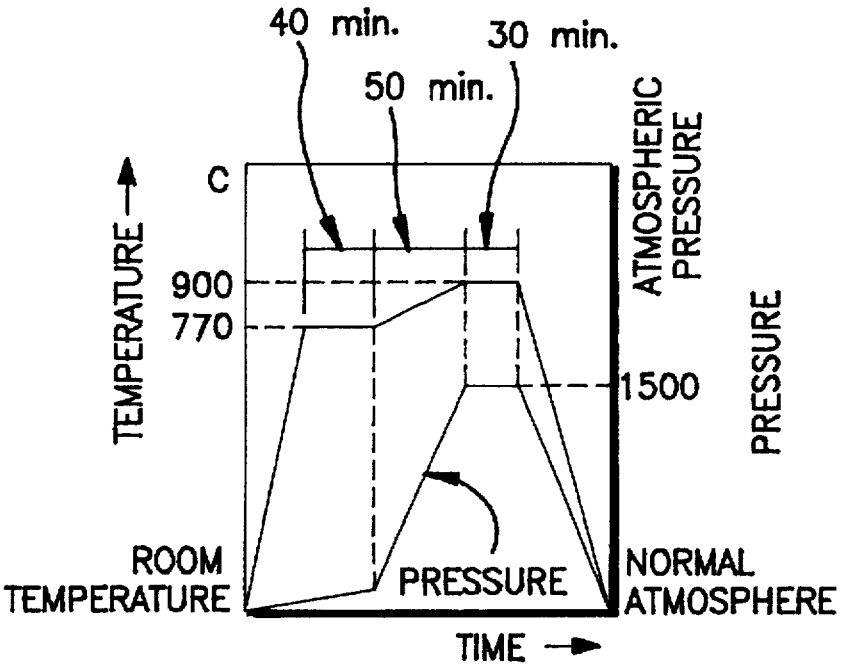
FIG. 3 is an explanatory view showing the temperature and the pressure program of the hot isostatic pressing (HIP) process, which is used for explaining the embodiment.

The glass capsule having the molded product therein is then inserted into a furnace of an HIP process apparatus (not shown), and the HIP process is carried out in accordance with a pressure program and a temperature which are shown in FIG. 3 (step 23 in FIG. 2). The temperature is maintained at 770° C. during the process because the pressure is applied after the glass is well softened. Values shown in FIG. 3 are only examples of the temperature, the pressure and the time of the HIP process. Sintering can be performed under conditions such that the temperature is set between 800° C. and 1500° C.; the pressure is set between 200 atmospheres and 2000 atmospheres; and the interval of time is arbitrary. It may be preferable that the temperature is set between 800° C. and 1000° C.; the pressure is set between 1000 atmospheres to 2000 atmospheres; and the interval of time is set between 20 minutes to 100 minutes. Although it may be considered that an appropriate sintering state can be obtained even when a maximum pressure exceeds 2000 atmospheres, a range of the pressure exceeding 2000 atmospheres is not practical because the HIP apparatus capable of dealing with a pressure above 2000 atmospheres is special.

Glass is used as a material for the capsule in the embodiment according to the present invention, but any metal such as soft steel or copper may be also used as a capsule material. In this case, as contrasted to the glass capsule, although the pressure can be applied before the metal capsule is softened, a metal having a softening point lower than a final heating temperature must be used.

Upon completion of the HIP process, a product sintered to be one body is removed from the glass capsule, and the thus-obtained product is subjected to the mechanical processing such as cutting and polishing to manufacture the cathode pellet 11 which has a predetermined shape and whose electron emitting surface is specular-processed (step 24 in FIG. 2). The finished cathode pellet 11 is inserted into the cathode cap 12 and the cathode sleeve 13, and the peripheral portion and the bottom face of this assembly are fixed by resistance welding or laser welding (step 25 in FIG. 2). The heater 14 is then inserted into the cathode sleeve 13 (step 26 in FIG. 2).

The finished cathode 10 is assembled into a CRT (not shown) (step 27 in FIG. 2), and the heater 14 is turned on during the exhaust and the cathode pellet 11 is heated at a temperature equal to or above 600° C. and equal to or below 1200° C. to carry out the thermal decomposition represented by the following expressions (step 28 in FIG. 2):

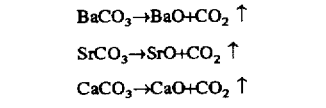

$$BaCO_3 \rightarrow BaO + CO_2 \uparrow$$

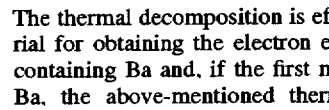

$$SrCO_3 \rightarrow SrO + CO_2 \uparrow$$

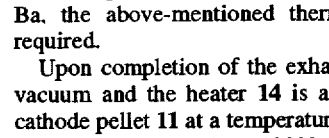

$$CaCO_3 \rightarrow CaO + CO_2 \uparrow$$

The thermal decomposition is effected because a first material for obtaining the electron emissive agent is carbonate containing Ba and, if the first material is oxide containing Ba, the above-mentioned thermal decomposition is not required.

Upon completion of the exhaust, the CRT is sealed in a vacuum and the heater 14 is again turned on to heat the cathode pellet 11 at a temperature equal to or above 600° C. and equal to or below 1200° C. to perform the thermal activation. The electron emission current is obtained to carry out the current activation while continuing the heating process at a temperature equal to or above 600° C. and equal to or below 1200° C. (step 29 in FIG. 2). An object of both the activations is to reduce BaO and cover the electron emitting surface of the cathode pellet 11 with the Ba atoms to lower the work function of the electron emitting surface. When the current activation is completed, the cathode 10 using the cathode member according to the present invention is obtained.

A description will now be given as to the electron emission characteristics of the cathode using the embodiment 1 of the cathode member according to the present invention in connection with FIG. 4.

Figure 4:
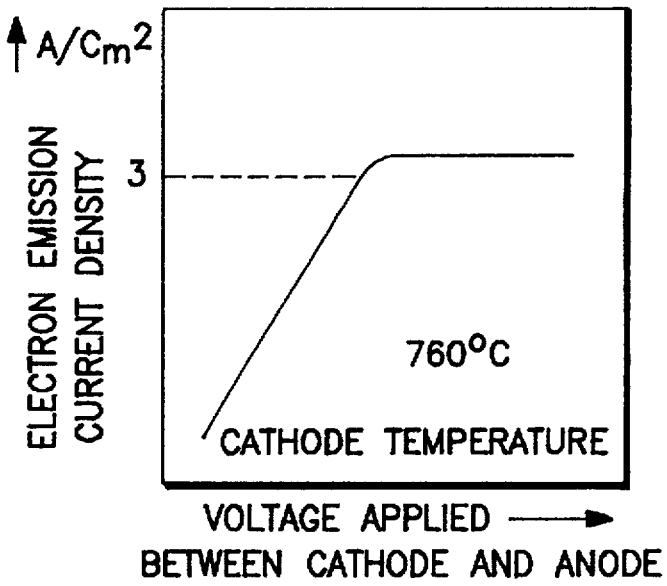
FIG. 4 is an explanatory view showing electron emission characteristics according to the embodiment of the present invention.

In FIG. 4, an axis of abscissa shows an applied voltage between a cathode and an anode while an axis of ordinate represents an electron emission current density on a logarithmic scale, values of which are obtained by assembling a cathode using the first embodiment 1 of a cathode member according to the present invention into a diode (not shown) and measuring a relationship between the applied voltage to the cathode and the anode and the electron emission current.

As shown in FIG. 4, a maximum current density 3 A/cm$^2$ was obtained at a cathode temperature 760° C. with the cathode using the embodiment 1 according to the present invention. This is a current density with which the sufficient brightness can be obtained for a CRT for an HDTV, a CRT for a large TV and a CRT for a high definition display.

Assuming that the relative electron emission current density when the absolute Ni alloy powder is produced in 1.0, the same when the Ni alloy powder including Mg and Si by the conventional vacuum dissolving method was 1.20, but this value was improved to 1.56 in accordance with the mechanical alloying method of the present invention.

Further, the cathode using the embodiment 1 according to the present invention was assembled into a CRT, and the focusing failure and the moire stripe defection due to the unevenness on the cathode surface were compared to those of the oxide coated cathode of the conventional example 1. Subsequently, the life test was carried out with the current density 3 A/cm$^2$ at a cathode temperature 760° C. to compare the reduction in the electron emission current with that of the oxide coated cathode of the conventional example 1 under the equivalent test condition.

The focusing failure and the moire strip defects due to the unevenness of the cathode surface were not found in the oxide coated cathode of the conventional example 1 under the severe condition with which usually these failures were prominently observed, and there was confirmed an effect that the cathode surface was smooth.

Moreover, in the life test, the reduction rate in the electron emission current of the embodiment 1 of the cathode according to the present invention was approximately 10% after 2000 hours of the continuous operation, but the reduction rate in the electron emission current of the conventional example 1 reached approximately 30%.

Mg and Si are used as the reductive metal in the above-described embodiment 1, and the characteristics which appear when Zr, Ta, Al, Co, Cr and W are used for the same purpose will be briefly explained.

Zr and Ta have a weak reduction behavior as compared to Mg and Si but produce less evaporation which leads to low possibility of unnecessary electron emission, and hence they are suitable for an electron tube having a high reliability.

Al has a reduction behavior equivalent to those of Mg and Si and shows characteristics similar to those of Mg and Si.

Co has a weak reduction behavior as compared to Mg and Si but produces less evaporation, and hence it is suitable for an electron tube which requires a long duration of life.

Cr has a reduction behavior equivalent to those of Mg and Si but its amount of evaporation is large, and thus it is preferable for an electron tube which requires a high initial characteristics in particular.

It may be suitable that the amount of the aforementioned Zr, Al, Co, Cr added to Ni is equal to that of Mg and Si.

Since the reduction behavior of W is very weak, its effect is limited, but it does not hardly evaporate, thus showing its reduction behavior for a long interval of time. Therefore, if the reductive metal having a strong reduction behavior such as Mg, Si, Al and Cr is used with W, the duration of life is prolonged and such a usage is thus preferable. Further, the amount of W added to Ni is large as compared to those of the other reductive metals, and its effect can be observed when used with the composition ratio equal to or above 1% by weight and equal to or below 10% by weight, and more preferably the ratio equal to or above 2% by weight and equal to or below 6% by weight.

Although Ni and the reductive metal are alloyed before the HIP process in the embodiment 1, the similar effect can be obtained by mixing the Ni powder, the reductive metal powder and the electron emissive agent and sintering them to be one body by the HIP process. The advantage of the latter case is that the Ni alloy containing the reductive metal is expensive but the entire cost is reduced because Ni and the reductive metal are inexpensive.

A manufacturing method of another embodiment (referred to as an embodiment 2 hereinbelow) of the cathode member according to the present invention will be described.

Ni alloy powder containing Mg and Si, $BaCO_3$ powder, $SrCO_3$ powder, $CaCO_3$ powder, and $Sc_2O_3$ powder are mixed by using a ball mill.

It was confirmed that: a mean particle diameter of the Ni alloy powder was 5 μm; a mean particle diameter of $BaCO_3$ powder, the $SrCO_3$ powder, the $CaCO_3$ powder and the $Sc_2O_3$ powder was 2 μm, respectively; a volume ratio of (the Ni alloy powder): (the $BaCO_3$ powder+the $SrCO_3$ powder+the $SrCO_3$ powder) was 45:55; and amounts of Mg, Si and $Sc_2O_3$ with respect to Ni were 0.1% by weight, 0.03% by weight and 5% by weight, respectively.

In regard of a ratio of the $BaCO_3$ powder, the $SrCO_3$ powder and the $CaCO_3$ powder, a mole ratio of Ba:Sr:Ca was 5:4:1.

Here, it is preferable that an amount ratio of the $Sc_2O_3$ powder which is an intermediate layer generation inhibitor is not less than 1% by weight and not more than 10% by weight with respect to Ni.

Since the structure, the manufacturing process and the HIP process temperature and pressure program of the cathode in the embodiment 2 are the same as those of the embodiment 1 shown in FIGS. 1, 2 and 3, respectively, the explanation is omitted.

The initial electron emission characteristics of the cathode using the embodiment 2 according to the present invention are substantially the same as those of the embodiment 1 of this invention, and the reduction rate of the electron emission current in the life test was ⅓ or below of that of the embodiment 1 of this invention.

When the intermediate layer generation inhibitor is any other rare earth metal or its oxide, i.e., Y, La, Ce and Dy or oxide thereof, the effect to inhibit the intermediate layer generation is inferior to that of $Sc_2O_3$, but this inhibitor is very inexpensive as compared to $Sc_2O_3$, and hence it is suitable when attaching greater importance to the cost than to the high performance.

It is appropriate that the addition amount of the above-described rare earth metal or its oxide is equal to that of $Sc_2O_3$.

When the intermediate layer generation inhibitor is an In compound, although the effect to inhibit the intermediate layer generation falls behind that of the rare earth metal or its oxide, it is further inexpensive.

As described above, according to the present invention, it is possible to inexpensively provide a cathode which has a good electron emission distribution on its surface at a low operation temperature and is capable of stably emitting electrons with a high current density for a long interval of time.

Further, it is possible to provide an inexpensive electron tube which has the cathode mounted thereon and has the properties of high brightness, long duration of life, low power consumption and high performance.

What is claimed is:

1. A cathode member comprising:

nickel (Ni); a metal having a reduction behavior; and an electron emissive agent, said cathode member being sintered to be one body by a hot isostatic pressing process and having a polished electron emitting surface, said Ni and said metal having a reduction behavior being alloyed before the hot isostatic pressing process.

2. A cathode member as set forth in claim 1, further comprising an intermediate layer generation inhibitor.

3. A cathode member as set forth in claim 1, wherein said metal having a reduction behavior is at least one kind selected from a group composed of Mg, Si, Zr, Ta, Al, Co and Cr.

4. A cathode member as set forth in claim 3, wherein said metal having a reduction behavior includes W.

5. A cathode member as set forth in claim 1, wherein said electron emissive agent is selected from Ba carbonate and Ba oxide.

6. A cathode member as set forth in claim 2, wherein said Ni and said metal having a reduction behavior are sintered to be one body by the hot isostatic pressing process.

7. A cathode member as set forth in claim 2, wherein said intermediate layer generation inhibitor is selected from a rare earth metal and its oxide.

8. A cathode member as set forth in claim 7, wherein said rare earth metal is at least one kind selected from a group composed of Sc, Y, La, Ce and Dy.

9. A cathode member as set forth in claim 2, wherein said intermediate layer generation inhibitor is an In compound.

10. A cathode member as set forth in claim 1, wherein said Ni and said metal having a reduction behavior are alloyed by a mechanical alloying method.

11. An electron tube comprising a cathode member defined in claim 1 mounted thereon.

12. A cathode member comprising:

nickel (Ni);

a metal having a reduction behavior; and an electron emissive agent selected from the group consisting of Ba carbonate, Sr carbonate, and Ca carbonate, said cathode member being sintered to be one body by a hot isostatic pressing process and having a polished electron emitting surface.

13. A cathode member according to claim 12, wherein said metal having a reduction behavior is at least one selected from a group consisting of Si, Zr, Ta, Al, Co and Cr.

* * * * *